United States Patent [19]

Nguyen

[11] Patent Number: 5,046,555

[45] Date of Patent: Sep. 10, 1991

[54] EXTENDED SURFACE TUBE-TO-HEADER CONNECTION FOR CONDENSER

[75] Inventor: Hung P. Nguyen, East Amherst, N.Y.

[73] Assignee: General Motors Corporation, Detroit, Mich.

[21] Appl. No.: 578,119

[22] Filed: Sep. 6, 1990

[51] Int. Cl.[5] ..... F28F 9/16

[52] U.S. Cl. ..... 165/173; 228/183; 29/890.43

[58] Field of Search ..... 165/153, 173; 228/183; 285/192, 332; 29/890.43

[56] References Cited

U.S. PATENT DOCUMENTS

| | | | |
|---|---|---|---|
| 3,027,142 | 3/1962 | Albers et al. | 257/154 |
| 3,920,069 | 11/1975 | Mosier | 165/150 |
| 4,351,390 | 9/1982 | Argyle | 165/149 |
| 4,515,305 | 5/1985 | Hagemeister | 228/173.2 |
| 4,544,029 | 10/1985 | Cadars | 165/149 |
| 4,707,905 | 11/1987 | Clair | 165/173 X |
| 4,825,941 | 5/1989 | Hoshino et al. | 165/110 |

FOREIGN PATENT DOCUMENTS

| | | | |
|---|---|---|---|
| 1404144 | 6/1988 | U.S.S.R. | 29/890.43 |
| 1232414 | 2/1968 | United Kingdom . | |

*Primary Examiner*—Allen J. Flanigan

*Attorney, Agent, or Firm*—Ronald L. Phillips

[57] ABSTRACT

A heat exchanger suitable for use as a condenser in an automotive air conditioning system has a pair of header tanks connected by flat extruded tubes. Air centers are sandwiched between the tubes for extracting heat from refrigerant directed through the flat extruded tubes. Each of the flat extruded tubes are located in spaced parallelism and each of the tubes have an end portion with a tapered outer surface for piloting the tube into contact with a mating tapered surface in a header opening and wherein the axial length of the end portion and the tapered surfaces are selected to define a brazed joint having maximized contact surface and strength. Each of the flat extruded tubes has a peripheral shoulder engageable either with the outboard surface of the header or with a countersunk surface portion thereof to precisely locate the end surface of each of the tube end portions with respect to avoid excessive tube stickout within the header tank volume.

8 Claims, 2 Drawing Sheets

EXTENDED SURFACE TUBE-TO-HEADER CONNECTION FOR CONDENSER

FIELD OF THE INVENTION

This invention relates to tube and header connections in heat exchangers and more particularly to tube and header connections for forming a brazed joint between the end of a tube pass and the wall of a header for flow of refrigerant between a compressor and a high pressure liquid refrigerant line in an automotive air conditioning system.

BACKGROUND OF THE INVENTION

Various tube to header connections have been proposed to provide a leak proof strong connection between tube passes and header tanks of heat exchanger assemblies such as radiators, evaporators, condensers and the like.

An example of one form of such tube to header connections is shown in U.S. Pat. No. 3,027,142. It has a header tank with a wall formed with a tube portion forming a support for the end of a tube pass. The tube pass is rolled against an O-ring to seal the tube to header joint.

British Patent 1232414 dated May 2, 1969, discloses a heat exchanger having a flat tube formed with circular ends or round ends that are deformed by metal spinning to be engaged with frustoconical surfaces formed in a header wall. A layer of adhesive is applied to the circular end portion prior to the metal spinning step to seal against leakage at the joint.

U.S. Pat. No. 4,825,941 discloses a condenser type heat exchanger having flat tubular elements with interposed heat exchanger fins sandwiched therebetween. Ends of the tubular elements are seated in a header slot and a brazed joint is formed at the interface between the ends of the tubular elements and the header.

While each of the aforesaid heat exchangers are suitable for there intended purpose they do not disclose how to form a bonded joint between a flattened tube pass and a header tank which will have an extended contact surface for improved bonding while assuring that the tube end of the flattened tube pass will extend into the header a controlled distance which will not interfere with fluid flow between inlet and outlet fittings of an associated system. More particularly, in the heat exchanger in the '142 patent the seal requires a separate gasket or a separate O-ring seal and it also requires that the end of the tube be rolled over to provide a mechanical connection between the header wall and the tube pass. The British Specification discloses a heat exchanger or radiator that requires that flat tube segments be formed to have circular end portions and further requires that the circular ends be deformed by metal spinning to seal against the header. The header walls must be fixtured with respect to the ends of the tube to assure that the tube ends are properly positioned for spinning connection to the header. Likewise the '941 patent must have the extruded tubes therein fixtured to form a desired connection between the header and the flattened tube.

In none of the aforesaid arrangements is there a provision of an inclined or tapered contact surface on the tube and header which combine to define an extended surface for forming a high strength brazed connection between a tube pass and the wall of an associated header component in a heat exchanger assembly. Furthermore, none of the aforesaid arrangements provide a shoulder surface for located the tapered surfaces to control the tube stickout length within the header volume.

SUMMARY OF THE INVENTION

The present invention is directed to a condenser for use in automotive air conditioning systems but has general application to other heat exchangers in which a strong connection joint is require between tube components and header components of the heat exchanger.

The condenser and other like heat exchangers have flat extruded hollow tubes formed from extrudable material such as aluminum. The tubes have heat exchange fins or air centers sandwiched therebetween through which air is directed to cool refrigerant passing through the hollow tube. The refrigerant passing through the hollow tubes is directed from a compressor to an inlet connected to a header having a first plurality of tubes connected thereto. A header at the opposite end receives cooled refrigerant from the inlet and collects it for return to an outlet. The outlet directs cooled refrigerant to a high pressure liquid refrigerant line.

While a condenser will be specifically discussed and illustrated in the following text, the invention is directed to a particular tube to header connection which is equally applicable to any heat exchanger in which a tube pass must be connected and sealed to a header for collecting and flowing a fluid through a tube pass.

The tube to header connection includes an inclined contact surface which is tapered to diverge outwardly from a distal end of a tube end portion on the hollow tube member. The tube end portion further includes a shoulder thereon that will engage a surface on the outboard surface of the header to control the position of the distal end of the tube end portion within the collection volume of the header. The inclined contact surface of the tube end portion is seated on a congruent mating surface of the tube header defined by an inclined contact surface thereon which diverges outwardly from the inboard surface of the header wall to the outboard surface thereof.

The tapered or inclined contact surface of the tube end portion is smaller at the inserted end thereof than the entrance opening into the inclined contact surface of the header wall such that the tube end portion will be guided into supported engagement with the header wall. Brazing compound coats the engaged surfaces between the header and the hollow tubes so that the hollow tubes will be brazed to the header wall when the assembled components are placed in known brazing furnaces and are raised to an elevated temperature. After cooling the joined parts will have a brazed joint formed therebetween.

One feature of the present invention is that the inclined contact or tapered surfaces provide a brazed joint with wall lengths greater than the axial length of the tube end portion and of greater length than the axial length of a header hole through which the tube end portion extends. The resultant brazed joint is stronger than brazed joints with conventional non-tapered tube end configurations with braze joints limited to the axial length of the tube end.

Another feature of the present invention is that in addition to having a brazed joint with extended length walls, the present invention defines a brazed joint which has a first part formed by the extended length walls of the mating tapered or inclined contact surfaces and a second part formed between the locating shoulders on the tubes and the outboard surface of the header.

Another feature of the present invention is the provision of a shoulder surface on the tube end portion which in one embodiment engages the outer surface of a header wall to control the position of the distal end of the hollow tube within the header tank and in another embodiment a shoulder on the tube end portion engages a counterbore surface in a header wall to provide such control of tube stickout within the header tank.

These and other objects, advantages, and features of the present invention will become more apparent from the following description and drawings in which:

DETAILED DESCRIPTION OF PREFERRED EMBODIMENTS

Figure 1:
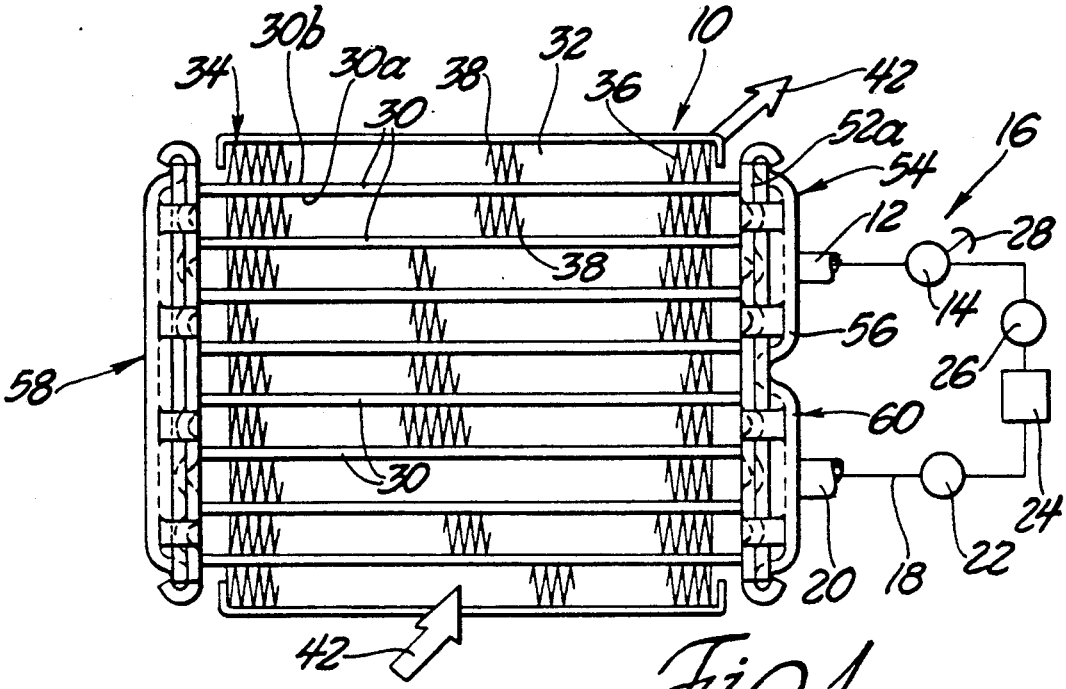
FIG. 1 is a front elevational view of a condenser including the present invention.

Referring now to FIG. 1, a condenser 10 is illustrated having an inlet 12 adapted to be connected to the discharge line of a compressor 14 in an automotive air conditioning system 16. The automotive air conditioning system 16 also includes a high pressure liquid refrigerant line 18 connected to an outlet 20 of the condenser. The high pressure liquid refrigerant line 18 includes a flow restrictor valve 22 therein for directing high pressure refrigerant liquid to the inlet of an evaporator 24 having its outlet connected to a receiver-dehydrator unit 26 from whence low pressure refrigerant vapor is returned to the suction inlet of the compressor. The compressor 14 is driven by an electromagnetic clutch 28 from the vehicle engine (not shown) to circulate refrigerant in the system under the control of known controllers such as set-forth in U.S. Pat. No. 4,375,228, assigned to the assignee of this invention.

The automotive air conditioning system and its component parts are only cited for purposes of showing a system in which a heat exchanger including the present invention has one application. As will become clearer from the following text, the present invention has use with other heat exchangers in other systems in which a heat exchanger requires a strong joint between header and tube components.

In the embodiment of FIG. 1, the condenser 10 includes a plurality of flat tubes 30 each located in generally spaced relationship to each other to form an air flow space 32 therebetween. An air flow center 34 is located in each of the air flow spaces 32. Each of the air flow centers 34 is made up of a metal heat exchanger fin bent into a plurality of reverse bends 36 having the bent portion 38 located in conductive heat transfer contact with spaced surfaces 30*a*, 30*b* of each of the tubes 30. In one embodiment, the bent portions 38 are attached to the walls 30*a*, 30*b* by a braze joint 40 formed by covering the interfaced surfaces between the air centers 34 and the surfaces 30*a*, 30*b* with a suitable known brazing compound and raising the temperature of the contacted surfaces between the air flow centers 34 and the surfaces 30*a*, 30*b* to an elevated temperature which will cause the brazing compound to melt and wet the surfaces to be joined. On cooling the parts will be bonded together by the braze material.

The air flow centers 34 have axial passages 34*a* through which air will flow as shown by arrows 42 to remove heat from the condenser so as to cause hot refrigerant gas flowing therethrough to be cooled and condense into high pressure liquid refrigerant.

Figure 6:
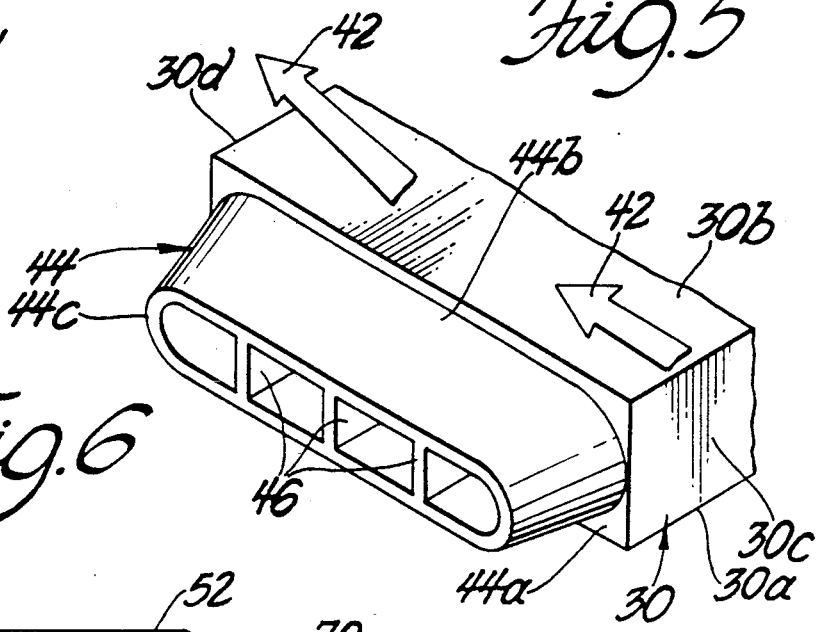
FIG. 6 is a perspective view of a tube end portion of the present invention.

One aspect of the present invention is to form the flat tubes as extruded tubes from a suitable extrudable material such as aluminum. The tubes are extruded through a suitable die to form the flats surfaces 30*a*, 30*b* on each tube and to form inlet and outlet air flow surfaces 30*c* and 30*d* (shown in FIG. 6). The surfaces 30*c* are located at the inlet of the condenser and the surfaces are located at the outlet of the condenser 10 in the direction of the air flow thereacross.

Another feature of the present invention is that each of the tubes 30 have a tube end 44 formed on opposite ends thereof. Each tube end 44 is configured to define an extended surface for bonding to a tube header wall to form a maximum strength sealed joint therebetween. To this end, each tube end 44 has a peripheral locating shoulder 44*a* formed thereon which merges with a inclined contact surface 44*b* that extends from the peripheral locating shoulder 44*a* to the distal end 44*c* of the tube end. The inclined contact surface 44*b* is tapered to diverge outwardly from the distal end 44*c* to merge with the shoulder 44*a*. At the distal end 44*c* the tube end 44 is configured as a flat hollow tube of somewhat flattened oval shape with the oval continually expanding in size until it reaches a maximum at the shoulder 44*a*.

In the illustrated embodiment, the flat hollow tubes 30 each have a plurality of integral reinforcing webs 46 extending through the open interior of each of the hollow tubes 40 end to end thereof. While the webs 46 are preferably formed as integral parts of the tubes 30 during the extruding process, they can be replaced by separate stiffeners 46*a* (FIG. 5) inserted in the hollow tube.

Figure 2:
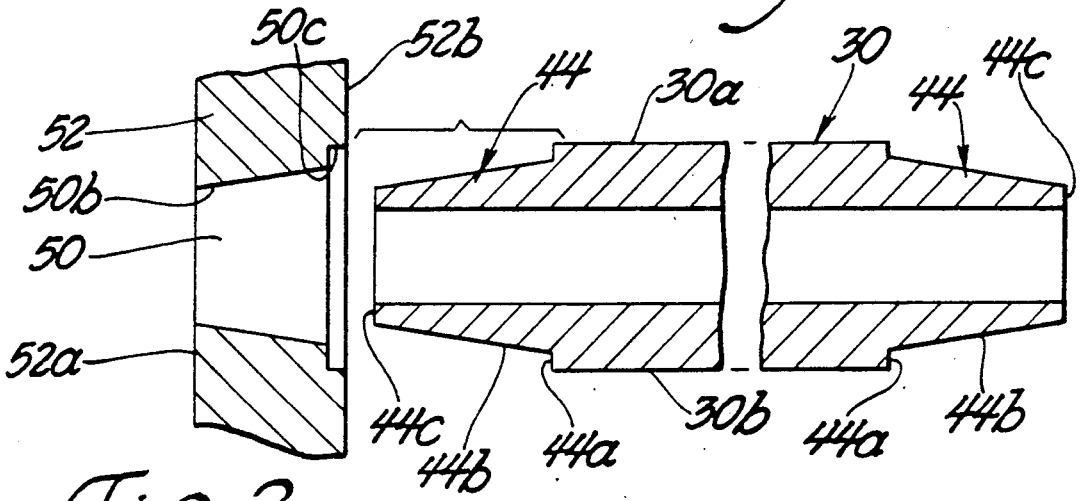
FIG. 2 is an enlarged fragmentary sectional view of a tube to header connection shown in an exploded relationship and embodying the present invention.
Figure 3:
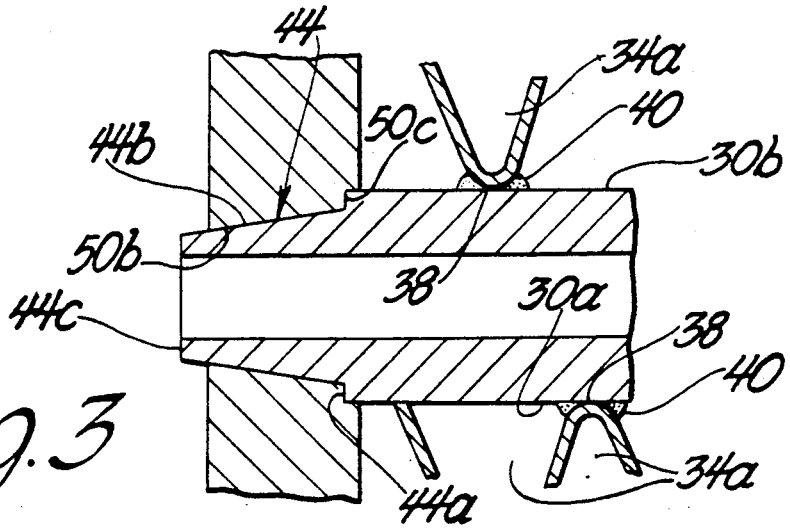
FIG. 3 is a view like FIG. 2 showing a tube end connected to a header wall.

In the embodiment of FIGS. 2 and 3, each of the tube ends 44 is guided into a seated relationship with a counterbored hole 50 in a header wall 52 by inserting the small oval end at the distal end 44*c* into the counterbored hole 50 until the distal end 44*c* is directed through the header wall 52. In FIG. 1, four of the tube ends 44 are directed through such holes in a header wall portion 52*a* of an inlet header 54. The inlet header 54 has a cover 56 fastened to the header wall portion 52*a* and the inlet 12 is sealed to the cover 56 for directing hot high pressure refrigerant into the condenser 10. The condenser 10 is located in the air stream of the moving vehicle and or has cooling air directed thereacross by the engine fan or an auxiliary fan but in any case is cooled by the air flow to condense the circulating hot compressed refrigerant vapor. In such condensers the header 54 is joined to a return header 58 by the tubes 30 and four of the tubes 30 return refrigerant from the header 58 to an outlet header 60 having the outlet 20 sealed to the cover portion 62 thereof.

In such structures, the tube to header joints must be strong enough to resist thermal cycling of the condenser from a cool ambient condition when the air conditioning is not operating to an elevated temperature condition when the air conditioning is operational. In such cases the joint between the tubes 30 and the headers are subjected to substantial compressive forces which require high strength to prevent the joints from cracking and leaking.

In accordance with the present invention, the length of the inclined contact surface 44*b* is longer than the axial length of the tube end 44. Likewise, the counterbored holes 50 each have an inclined contact surface 50*b* which will support the inclined contact surface 44*b* of the tube end 44. The inclined contact surface 50*b* is tapered outwardly from the inboard surface 52*a* of the header wall 52 to the outboard surface 52*b* of the header wall 52. The degree of taper of the inclined contact surface 50*b* is congruent with the taper of the inclined surface 44*b* of the tube end 44 so that the small oval end at the distal end of the tube end 44 will be guided thereby until the surfaces 44*b* and 50*b* mate as shown in FIG. 3. The surfaces 44*b*, 50*b* can be precoated with a suitable brazing compound so that a sealed joint will be formed between the tube end 44 and the header wall 52 when the joined components are raised to an elevated brazing temperature in a braze oven. The tube to header wall and air center to tube connections are brazed at the same time.

In another aspect of the present invention the shoulder 44*a* is engaged with a counterbore surface 50*c* of the hole 50 to form a positive location for controlling the depth of penetration or tube stickout distance within the interior space of a header joined to the hollow tubes 30. In the case of condensers such penetration must be carefully controlled to smooth flow of condensed liquid and vapor refrigerant at the tube ends so as to avoid increased pressure drop in the refrigerant flow through the condenser 10.

Another feature of the invention is that the shoulder 44*a* and counterbore surface 50*c* can be coated with brazing material to form an additional braze joint portion that will further reinforce the braze joint formed between the tube end 44 and the header wall 52.

Figure 4:
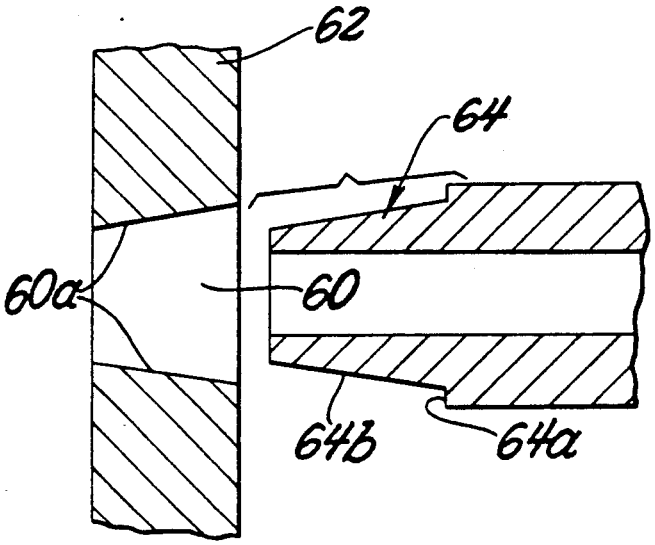
FIG. 4 is a view like FIG. 2 showing another embodiment of the invention.
Figure 5:
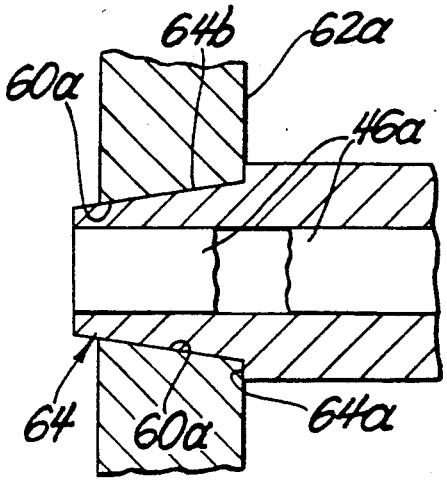
FIG. 5 is a view like FIG. 4 showing a tube end connected to a header wall.

The embodiment of FIGS. 4 and 5 is like the embodiment of FIGS. 2 and 3. The braze joint is formed at a hole 60 in a header wall 62. The hole 60 is formed with an inclined contact surface 60*a* having a length greater than the axial length of the hole 60. The size of the inboard end of the hole 60 is great enough to provide full penetration of the tube end into the interior of a header and to provide mating contact between the inclined contact surface 60*a* and the inclined contact surface 64*b* of a tube end 64. The tube end 64 is formed on the end of a hollow flat tube of the form described in the embodiment of FIGS. 2, 3 and 6, but in this embodiment there is no counterbore surface to receive a peripheral shoulder 64*a* on the tube end 64. Rather, tube end penetration is controlled by engagement of the peripheral shoulder 64*a* with the outboard surface 62*a* of the header wall 62 as seen in FIG. 5. The inclined contact surfaces 60*a*, 64*b* combine to form a first braze joint connection formed by braze material coatings thereon melting and wetting the surfaces when raised to an elevated brazing temperature. At the same time, if desired a second braze joint part can be formed between the peripheral shoulder 64*a* and the contacting portion of the outboard surface 62*a* (again coating the respective mating surfaces with suitable brazing material).

Figure 7:
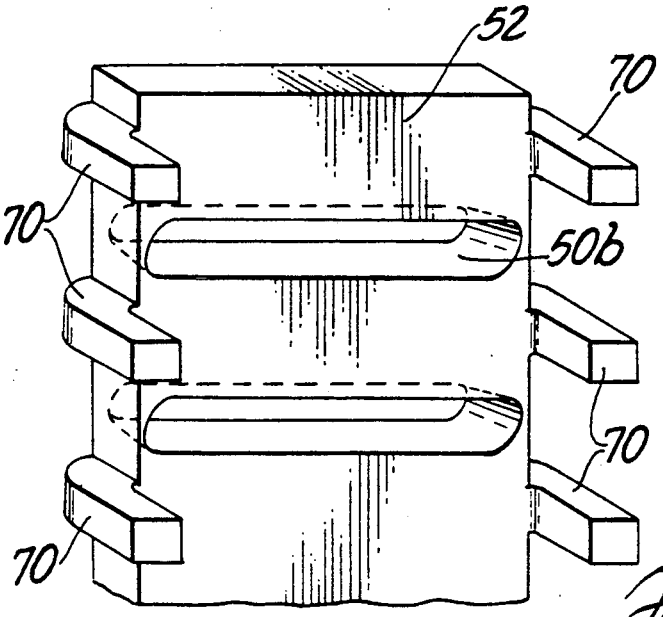
FIG. 7 is a view in perspective of a header tank wall with clinch tabs for connection to the header tank cover.

In yet another aspect of the present invention each of the header tank walls can be provided with clinch tabs 70 shown in FIG. 7. The tubes 30 and header walls 52 can be joined by brazing to form the extended length high strength joints of the present invention. Thereafter header covers can be placed on the walls and secured thereto by brazing the clinch tabs 70 into interlocked relationship therewith.

Figure 8:
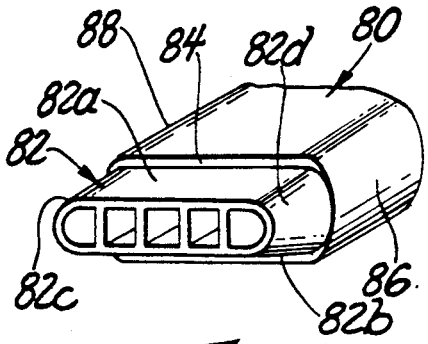
FIG. 8 is an oblique view of a tube end portion of another embodiment of the invention.

Yet another embodiment of the invention is set forth in FIG. 8, which shows an extruded tube 80 having a tube end 82 with a shoulder 84 engageable with a header wall. In this embodiment, the tube end 82 is only inclined at top and bottom surfaces 82*a*, 82*b* of the tube end 82. The sides 82 and 82*d* of the tube end 82 are in the same plane as curved surfaces 86, 88 of the extruded tube. The resultant extruded tube 80 simplifies the shape of the tube extrusion die while providing a tube end 82 configuration with straight sides but with inclination to provide an extended surface high strength connection in accordance with the invention.

The above-described embodiments are illustrative of the invention with it being understood that modifications can be made to these embodiments within the invention as set forth in the following claims.

What is claimed is:

1. A heat exchanger assembly having brazed connections between the ends of tube passes and the walls of spaced headers and wherein the tube passes are arranged in generally spaced parallelism and with end portions that are arranged with longitudinal axes thereof generally perpendicular to header walls characterized by:

each of said tube passes having an end portion with reinforcing ribs internal thereof and a distal end and a longitudinal axis and said end portion having a predetermined axial length greater than the wall thickness of a header connected to the end portion;

said end portion having a tapered outer surface having a length greater than the predetermined axial length of said end portion;

each of said header walls having an inboard surface and an outboard surface and a mating hole therein extending between said inboard and outboard surfaces for receiving said end portion; said mating hole having an axial length equal to the thickness of said header wall; said mating hole having a tapered surface thereon with a length greater than the thickness of said header wall but less than the length of said end portion;

said tapered surface of said mating hole engaged with said tapered outer surface of said end portion to locate said distal end of said end portion inside of said inboard surface of said header wall and means forming a brazed joint at said header wall and each of said tube end portions which is longer than the axial length of each of said end portions.

2. The heat exchanger of claim 1 further characterized by each of said heads walls having a cover portion separable from said header walls thereof and tabs formed on said header walls for joining said header walls and said tube passes connected thereto to said cover portions.

3. A heat exchanger assembly having brazed connections between the ends of tube passes and the walls of spaced headers and wherein the tube passes are arranged in generally spaced parallelism and with end portions that are arranged with longitudinal axes thereof generally perpendicular to header walls characterized by:

each of said tube passes having an end portion with a distal end and a longitudinal axis and said end portion having a predetermined axial length greater than the wall thickness of a header connected to the end portion;

said end portion having a tapered outer surface having a length greater than the predetermined axial length of said end portion;

each of said header walls having an inboard surface and an outboard surface and a mating hole therein extending between said inboard and outboard surfaces for receiving said end portion; said mating hole having an axial length equal to the thickness of said header wall; said mating hole having a tapered surface thereon with a length greater than the thickness of said header wall but less than the length of said end portion;

said tapered surface of said mating hole engaged with said tapered outer surface of said end portion to locate said distal end of said end portion inside of said inboard surface of said header wall and means forming a brazed joint at said header wall and each of said tube end portions which is longer than the axial length of each of said end portions;

means between said header wall and said end portion joined to form a brazed joint having first and second connection areas;

said end portion having a peripheral shoulder formed therearound in engagement with said outboard surface when said tapered outer surface is engaged by said tapered wall portion of said header wall;

said tapered outer surface of said end portion and said tapered wall portion of said header opening defining the first connection area of said brazed joint; said peripheral shoulder located in engagement with the outboard surface of said header wall when said first connection area is formed to define the second connection area in said brazed joint.

4. The heat exchanger of claim 3 further characterized by said end portion having a peripheral shoulder; said end portion having an oval shape at said end surface and having an oval shape at said peripheral shoulder and said tapered surface being formed as an inclined surface between said end surface and said peripheral shoulder.

5. The heat exchanger assembly of claim 3 further characterized by said end portion having an oval shape at said end surface and having an oval shape at said peripheral shoulder and said tapered surface being formed as an inclined surface between said end surface and said peripheral shoulder.

6. A heat exchanger assembly having brazed connections between the ends of tube passes and the walls of spaced headers and wherein the tube passes are arranged in generally spaced parallelism and with end portions that are arranged with longitudinal axes thereof generally perpendicular to header walls characterized by:

each of said tube passes having an end portion with a distal end and a longitudinal axis and said end portion having a predetermined axial length greater than the wall thickness of a header connected to the end portion;

said end portion having a tapered outer surface having a length greater than the predetermined axial length of said end portion;

each of said header walls having an inboard surface and an outboard surface and a mating hole therein extending between said inboard and outboard surfaces for receiving said end portion; said mating hole having an axial length equal to the thickness of said header wall; said mating hole having a tapered surface thereon with a length greater than the thickness of said header wall but less than the length of said end portion;

said tapered surface of said mating hole engaged with said tapered outer surface of said end portion to locate said distal end of said end portion inside of said inboard surface of said header wall and means forming a brazed joint at said header wall and each of said tube end portions which is longer than the axial length of each of said end portions;

said header wall having an outboard surface with a counterbore formed therein defining a locating surface;

means between said header wall and said end portion joined to form a brazed joint having first and second connection areas;

said end portion having a peripheral shoulder formed therearound in engagement with said locating surface of said counterbore when said tapered outer surface is engaged by said tapered wall portion of said header wall;

said tapered outer surface of said end portion and said tapered wall portion of said header wall joined to define the first connection area of said brazed joint; said peripheral shoulder located in engagement with the locating surface of said counterbore when said first connection area is formed to define the second connection area in said brazed joint.

7. The heat exchanger assembly of claim 6 further characterized by said end portion having an oval shape at said end surface and having an oval shape at said peripheral shoulder and said tapered surface being formed as an inclined surface between said end surface and said peripheral shoulder.

8. A heat exchanger assembly having brazed connections between the ends of tube passes and the walls of spaced headers and wherein the tube passes are arranged in generally spaced parallelism and with end portions that are arranged with longitudinal axes thereof generally perpendicular to header walls characterized by:

each of said tube passes having an end portion with a distal end and a longitudinal axis and said end portion having a predetermined axial length greater than the wall thickness of a header connected to the end portion;

said end portion having a tapered outer surface having a length greater than the predetermined axial length of said end portion;

said header walls having an inboard surface and an outboard surface and a mating hole therein extending between said inboard and outboard surfaces for receiving said end portion; said mating hole having an axial length equal to the thickness of said header wall; said mating hole having a tapered surface thereon with a length greater than the thickness of said header wall but less than the length of said end portion;

said tapered surface of said mating hole engaged with said tapered outer surface of said end portion to locate said distal end of said end portion inside of said inboard surface of said header wall and means forming a brazed joint at said header wall and each of said tube end portions which is longer than the axial length of each of said end portions;

said tube passes having first curved surfaces; said end portion having second curved surfaces in the same plane as said first curved surfaces; said tapered outer surface formed only on the top and bottom of said end portion.

* * * * *